US005935016A

United States Patent [19]

Antonious

[11] Patent Number: 5,935,016

[45] Date of Patent: Aug. 10, 1999

[54] IRON TYPE GOLF CLUB HEAD WITH OFFSET HOSEL AND ENLARGEMENT

[76] Inventor: Anthony J. Antonious, 7738 Calle Facil, Sarasota, Fla. 34238

[21] Appl. No.: 08/954,287

[22] Filed: Oct. 20, 1997

Related U.S. Application Data

[63] Continuation-in-part of application No. 08/808,990, Feb. 20, 1997, abandoned.

[51] Int. Cl.[6] ..... A63B 53/04

[52] U.S. Cl. ..... 473/305; 473/324; 473/349; 473/350

[58] Field of Search ..... 473/324–350, 473/314, 287–292, 305–312; D21/747, 748, 749

[56] References Cited

U.S. PATENT DOCUMENTS

| | | | |
|---|---|---|---|
| 669,864 | 3/1901 | Simpson | 473/314 |
| 1,550,501 | 8/1925 | Byrne . | |
| 3,020,048 | 2/1962 | Carroll . | |
| 3,947,041 | 3/1976 | Barber | 473/314 |
| 4,211,416 | 7/1980 | Swanson . | |
| 4,345,763 | 8/1982 | Swanson . | |
| 4,512,577 | 4/1985 | Solheim . | |
| 5,125,662 | 6/1992 | Antonious | 473/314 |
| 5,183,255 | 2/1993 | Antonious | 473/314 |
| 5,328,171 | 7/1994 | Saito | 473/314 |

*Primary Examiner*—Sebastiano Passaniti
*Attorney, Agent, or Firm*—Aquilino & Welsh

[57] ABSTRACT

An iron type golf club head includes a club head body having a heel portion, toe portion, bottom sole, top ridge, planar ball striking face including an enlarged hitting area adjacent the heel portion and a permanently non-rotatable hosel affixed to the club head body outside the outer periphery thereof by a connector extending the hosel laterally in a heel to toe direction and also offset beyond the leading edge of the club face, in a rear to front direction, permitting full ball striking face contact, without shanking, for hitting a golf ball during the execution of a golf shot.

11 Claims, 6 Drawing Sheets

FIG. 8
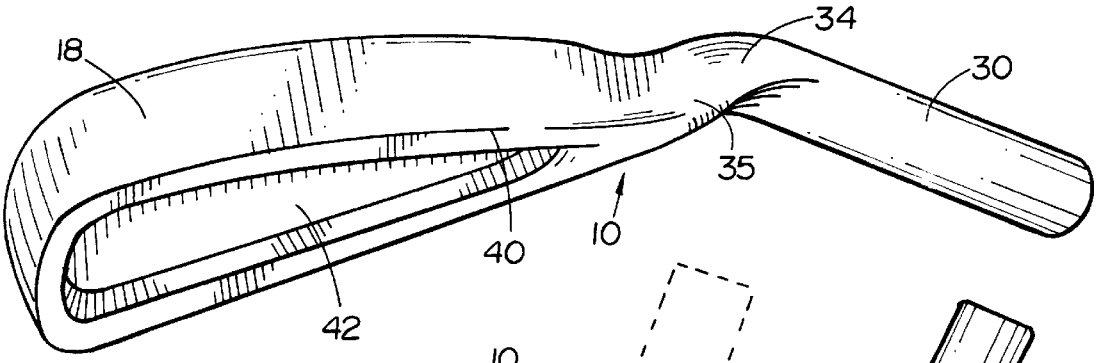
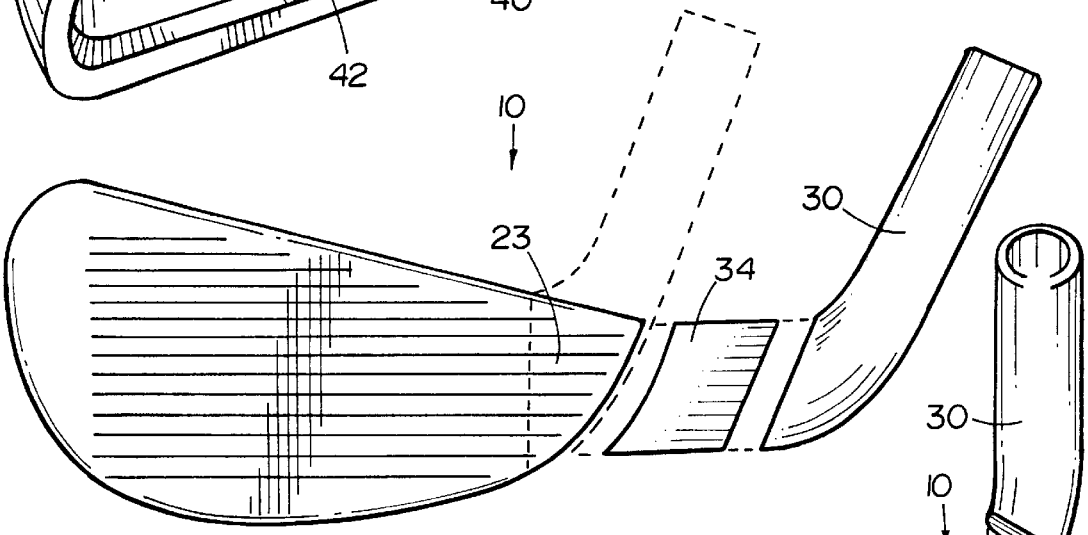
FIG. 10
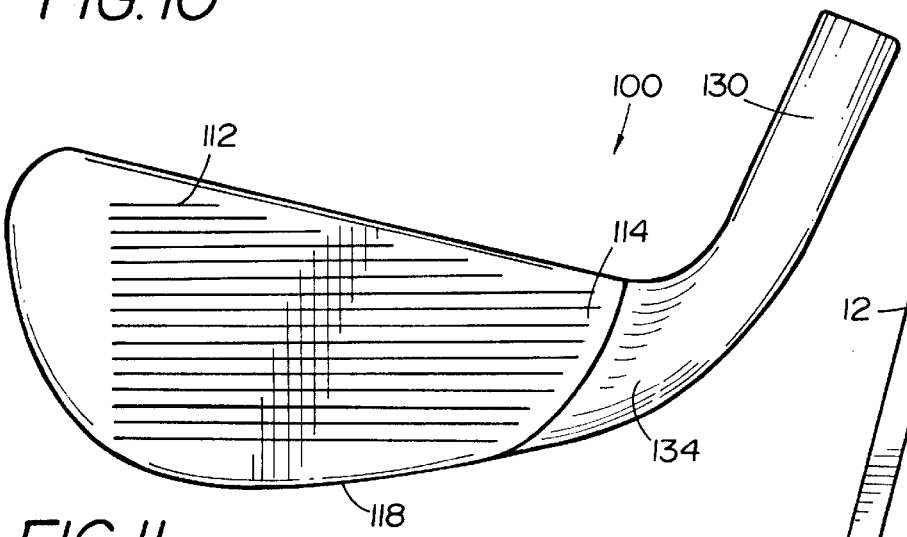
FIG. 11
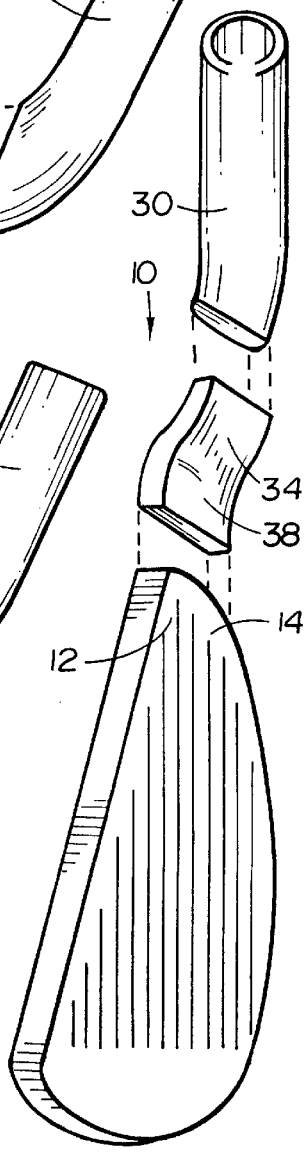
FIG. 9

IRON TYPE GOLF CLUB HEAD WITH OFFSET HOSEL AND ENLARGEMENT

RELATED INVENTIONS

The present application is a continuation-in-part of U.S. patent application Ser. No. 08/808,990 filed Feb. 20, 1997 now abandoned.

BACKGROUND AND SUMMARY OF THE INVENTION

The present invention relates to iron type golf club heads, and in particular, to an iron type golf club head having an improved hosel structure.

Conventional iron type golf club heads include a hosel having a shaft socket and a base which is attached directly to the heel section of the club head. This type of hosel is offset wherein the shank portion of the hosel protrudes beyond the club face exposing it to a golf ball which, if hit toward the heel area, causes the ball to veer off in an eccentric direction upon striking the pocket formed at the heel section of the club head face and the hosel. The shot, well known in the game as a "shank", occurs because conventional club heads are normally offset rearwardly from the hosel center line and have a rearward face progression. With this conventional structure, a shank results if the club face is swung outside the intended swing path. The offset section of the hosel has a very abrupt or sharp angle ranging from 45° to 90° extending from the club face, creating a very deep pocket at the heel section of the club head. The base of the hosel extends vertically from the bottom of the heel to an upper portion of the heel section of the club head transitioning or connecting to the club face and sole of the club head.

Attempts to produce golf club heads which are shankproof include my own U.S. Pat. Nos. 5,601,498 and 5,183,255, which are incorporated herein by reference, relating to golf clubs with improved hosel constructions, wherein the hosel is positioned by a connector behind the leading edge of the ball striking face, at the heel portion.

The '498 patent features and discloses that "no portion of the hosel extends beyond the leading edge of the clubface, in a rear to front direction".

Other patents of interest include the following. U.S. Pat. No. 1,550,501 to Byrne shows a golf club head wherein the hosel is connected above the club head body and completely behind the ball striking face, producing a club head wherein the ball striking face is entirely ahead of the center line of the shaft.

U.S. Pat. No. 2,683,036 to Kline discloses a golf iron wherein the hosel is located behind the ball striking face and the longitudinal axis of the hosel is behind or fully to the rear of the club head. Kline teaches that a portion of the heel of the club extends beyond the hosel and the shaft connects to the hosel above at least the heel portion of the club head.

U.S. Pat. No. 3,946,041 to Barber relates to a club head using a bridging portion connecting the hosel and club head whereby the bridging portion and the hosel are essentially flat surfaces continuous with the surface of the club face.

U.S. Design Pat. No. 302,715 to Petersen shows a low lofted iron wherein the hosel connection is essentially an extension of the ball striking face. The shaft extends into the hosel and terminates above the club head body.

U.S. Pat. No. 4,211,416 to Swanson discloses a club head having a hosel extending rearwardly from the rear face of the blade at the heel end and then is inclined away from the heel and forwardly and upwardly to position the bottom end of the club head shaft forward and above the upper end of the blade.

U.S. Pat. Nos. 1,594,850 to Perkins and 1,135,621 to Roberts and Canadian Patent No. 447094 to Nilson each disclose a single adjustable golf club head in which the hosel and shaft of the club are rotatably connected to the club head so that the loft of the club may be varied, as desired, for a particular golf shot.

Other patents of interest are U.S. Pat. Nos. 4,632,400 to Boone, 5,106,088 to Saito, 5,328,171 to Saito, 5,377,978 to Lee, 5,380,005 to Hau, 5,511,780 to Vadersen, 5,542,666 to Chou, 5,588,922 to Schmidt et al, and D276,836 to Cook.

The present invention provides a shankproof iron type golf club head which improves upon the prior art including the above described patented clubs. The iron type club head of the present invention does not include a shank portion forming a pocket between the base of the hosel and the ball striking face, thus presenting a totally unencumbered ball striking area on the club face between the extremities of the toe and heel portion of the club head.

The hosel structure of the present invention is designed for use with iron type golf club heads ranging in loft from approximately 12 degrees to increased lofts in the range of 60° and 65°, and even more. Preferably, a club head body includes a heel portion, a toe portion, a sole or bottom surface, a top ridge and a planar lofted ball striking face. A leading edge is formed at the interface of the ball striking face and the bottom sole surface. The most outward exterior surfaces of the heel portion, toe portion, bottom sole and top ridge define the outer periphery of the club head. The club head body of the present invention is shown with a rear peripheral weight and cavity, but it will be appreciated that the invention is equally applicable to forged type flat back or muscle back head structures.

The golf club head of the present invention includes a J-shaped structure which is permanently and non-rotatably fixed to the club head body at the outer edge of the heel portion forming the outer periphery. The structure includes a hosel which is generally cylindrical in shape and includes, at its upper section, a shaft socket for connection to a club shaft. The lower end of the hosel gradually transitions into a curved connector which together with the hosel, forms a generally J-shape and intersects with the heel portion of the club head. The connector smoothly transitions between the base of the cylindrical hosel and the expansion area of the ball striking face at the extreme heel portion of the club head.

The area between the connector and the expanded section of the ball striking face adjacent to the heel portion is slightly curved but the overall direction is generally parallel to the hosel thereby creating a larger ball striking surface at the heel portion of a standard size club face. This angular relationship and unobstructed configuration adjacent to the heel portion and the connector permits the expansion of an additional safe hitting area on the ball striking face further toward the hosel without being encumbered by the same. It will be appreciated that the lie angle of the hosel will vary slightly from club to club in a set, the longer, less lofted clubs being more upright than the shorter more lofted clubs. Also lie angles vary for golfers of different heights. Therefore, the parallel relationship of the club face and the hosel offset may diverge as much as plus or minus 12 degrees.

The top portion of the connector is coincident with and intersects the top ridge of the club head. The lower edge of the connector intersects the heel portion of the club head body at a point raised above the bottom or sole surface of the club head whereby no portion of the hosel or connector is able to contact the ground surface during the proper execution of a golf shot. The connector is wider and flatter than the cylindrical hosel.

The connector is attached to the club head body outside of the peripheral outer limits whereby no portion of the connector or hosel extends onto or above the ball striking face, thus eliminating the possibility of a "shank" golf shot while providing a full extension of the ball striking face in a heel to toe direction for hitting a golf ball. Stated in other words, the hosel is located in a lateral direction away from the extreme heel end of the club head body by the connector which extends outwardly in a generally toe to heel direction before curving upwardly to meet the hosel which is connected to the shaft and which the hosel is also offset beyond or is positioned in front of the leading edge of the club face. The present invention, unlike the '498 patent, teaches and discloses the displacement of the off-set hosel, "located away from and extending beyond or in front of the leading edge of the ball striking face", in a rear to front direction. This displacement of the offset hosel away from and extending beyond or in front of the leading edge of the ball striking face in a rear to front direction, completely eliminates the "pocket" normally found between a hosel and the heel portion of a conventional type club head, thus totally eliminating the possibility of a "shank" golf shot caused by balls being "trapped" in the "pocket".

The lower portion of the connector, which extends horizontally away from the heel area of the club head, provides considerable clearance above the ground when the club is soled at address and during the lowermost arc of the swing during the proper execution of a golf shot. The connector extends from the top ridge to approximately ¾ of the height of the club face at the intersection of the heel portion of the club head. The unique hosel construction provides a greater mass concentration toward the middle and upper portions of the club head which transfers more energy to the central section of the club face which also reduces backspin. This produces lower trajectory golf shots, thus preventing ballooning into the wind, rapid elevation and erratic ball flights as often happens with club heads with extreme bottom weighting. The reduction of backspin when a golf ball is struck by the club head of the present invention tends to keep the golf ball on line. By extending the hosel horizontally away from the ball striking face and also forwardly of the leading edge of the clubface, more of the clubface at the heel portion of the club head body is available for meaningful ball contact; up to approximately ⅓ more additional area compared to standard size club faces having conventional hosel structures.

The visual enlargement of the additional hitting area on the clubface is uniquely combined with the relocated, redesigned offset hosel that extends in front of the clubface. This dramatically increases a golfer's confidence and quickly establishes that he can repeatedly make more rewarding, solid ball contacts practically anywhere on the clubface. The present invention accomplishes these improvements while retaining an overall "raditional look", making it more easily acceptable for most golfers, especially the "high handicap" golfers. By locating the offset hosel, substantially away from and in front of the clubface, the hosel is formed at a "set position" ahead of the clubface to enhance obtaining the optimum "hands positioned", forward of the ball, at address for each clubhead. This facilitates making the proper initial golf swing move necessary to cleaning and crisply contact the golf ball, for best results. All of these built-in features are designed to reduce the margin of human error which will provide more enjoyment and lasting satisfaction for all caliber of golfers.

Among the objects of the present invention is to provide a shankproof type golf club head which does not include a traditional type shank portion of an offset hosel and eliminates shanked golf shots.

Another object of the present invention is the provision of a shankproof iron type golf club having an offset hosel extending beyond the leading edge of the club face.

Still another object of the present invention is the provision of a traditionally standard size iron type golf club head with an offset hosel forward of the leading edge of the club face and having a greater available hitting area on the ball striking face, particularly at the heel portion of the club face, which instills greater confidence and assurances that acceptable or playable ball contact can be made by the golfer anywhere on the hitting area of the club face.

Another object of the present invention is to provide an iron type golf club face where club head control and stability are greatly improved by providing a club head with resistance to torquing and twisting, particularly when off-center ball contact occurs.

Other objects and advantages of the present invention will become apparent from the following detailed description when viewed in conjunction with the accompanying drawings, which set forth certain embodiments of the invention. It will be appreciated that both the foregoing general description and the following detailed description are exemplary and explanatory only. The accompanying drawings are included to provide a further understanding of the invention and are incorporated in and constitute a part of the specification to illustrate the embodiments of the invention which, together with the description, serve to explain the principles of the invention.

BRIEF DESCRIPTION OF THE DRAWINGS

FIG. 8 is a bottom view.

FIG. 9 is a top plan exploded view of the golf club head of FIG. 1.

FIG. 10 is an elevational exploded view.

FIG. 11 is a front elevational view of a second embodiment of a golf club head in accordance with the present invention.

DESCRIPTION OF THE PREFERRED EMBODIMENTS

Figure 1:
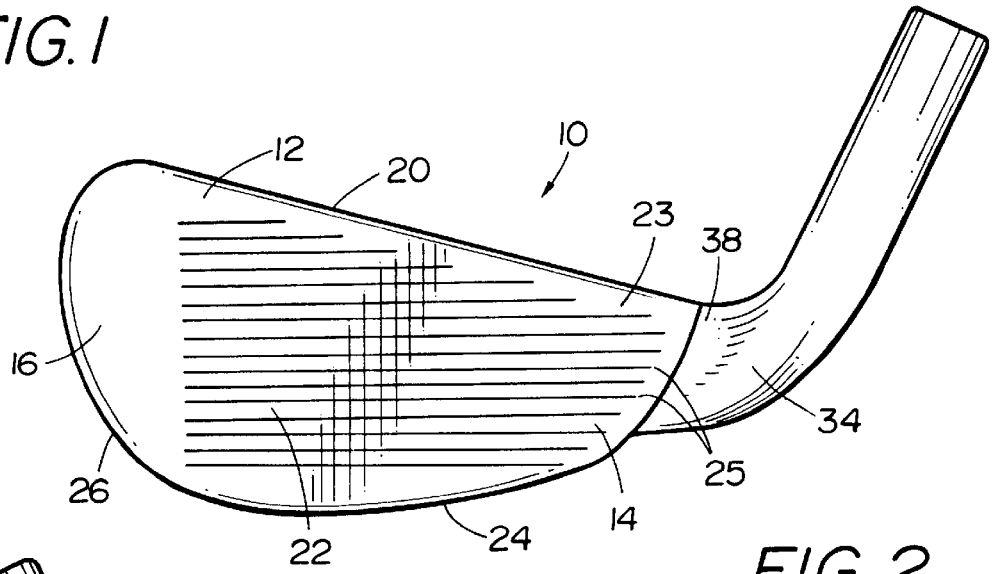
FIG. 1 is front perspective view of a first embodiment of an iron type golf club head in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, FIGS. 1–7 show a first embodiment of a typical cavity backed peripheral weighted iron type golf club head 10 in accordance with the present invention. The club head 10 shown in the drawings is typically a mid iron, such as five iron or six iron. However, it will be appreciated that the structure of the present invention is equally applicable to lower lofted irons as well as high lofted irons including pitching, sand and lob wedges. The golf club head 10 includes a club head body 12 having a heel portion 14, a toe portion 16, a bottom sole 18, a top ridge 20, and a planar, lofted ball striking face 22 preferably having a loft greater than 12 degrees. The ball striking face 22 intersects with a forwardmost progression of the bottom sole 18 to define a leading edge 24 of the club face. An outer periphery 26 of the club head 10 is defined by the most outward exterior surfaces of the heel portion 14, bottom sole 18, toe portion 16, and top ridge 20 and extends completely around the club head body 12. As can be seen from FIG. 1, the ball striking face 22 extends to the edges of the outer periphery 26, especially at the heel portion 14, and provides the area of the club head 10 which is used to contact a golf ball during an execution of a golf shot.

As shown in the drawings, it will be appreciated that the entire ball striking face is planar from the toe portion 16 to the heel portion 14. The club head 10 includes a hosel 30 which is permanently and non-rotatably fixed to the body 12 adjacent the heel portion 14 such that the entire hosel 30 is located beyond the outer periphery 26 of the club head body 12. The hosel 30 is cylindrical and includes a shaft socket 32 at the extreme upper end thereof in order to connect to and receive a conventional golf club shaft (not shown).

As seen particularly with reference to FIG. 1, the base of the hosel 30 attaches to a connector 34 which curves away from a longitudinal axis 36 of the hosel 30 inwardly toward the club head body 12 at the heel portion 14 in an overall J-shaped configuration. The connector 34 has a planar front surface 38, which is progressively wider in a curved configuration until it is coincident with the ball striking face 22. The edge of the connector 34 adjacent to hitting zone 23 at the heel portion 14 of the club head body 12 is slightly sloped upwardly and is substantially parallel to the hosel 30. This provides an additional grooved hitting zone 23 on the ball striking face 22, at the extreme heel portion 14 for hitting a golf ball. The extreme inner edge of the additional hitting area 23 is defined by the ends of the grooves 25 terminating adjacent to surface 38 of connector 34.

Figure 20:
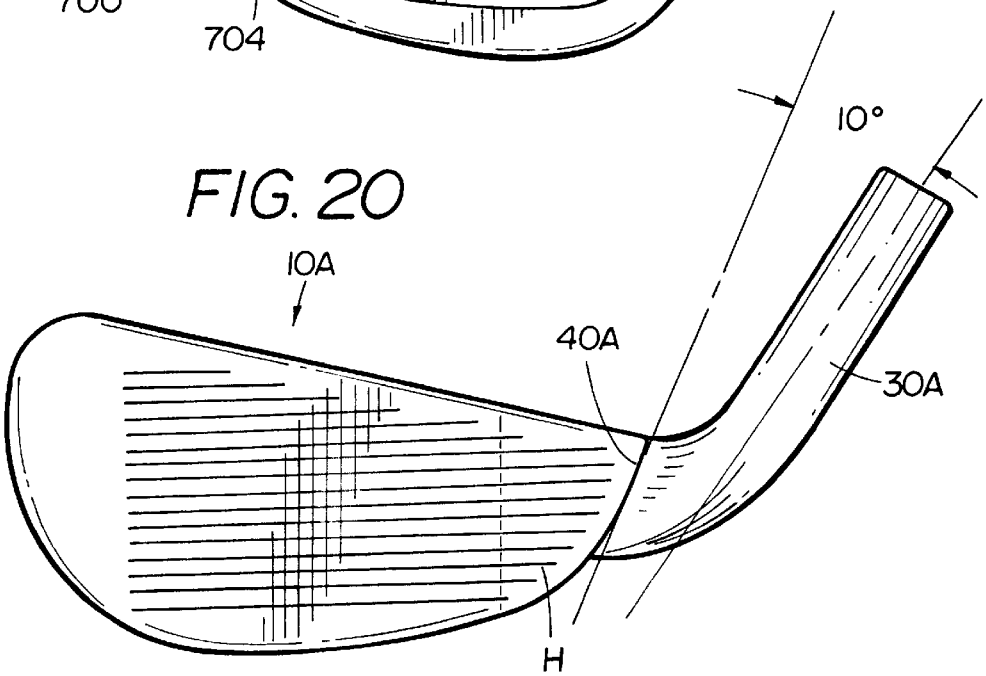
FIG. 20 is a front elevational view of a golf club head of the type shown in FIG. 1 with a larger lie angle.

The relationship between the enlarged hitting area 23 and the hosel 30 may vary up to plus or minus 12 degrees depending upon the lie angle of the golf club. Reference FIG. 20 which shows a golf club head 10A which is similar to golf club head 10 except for a larger lie angle. In this drawing the angle between the hosel 30A and the expanded hitting zone 23 on the club face diverges approximately 10 degrees from parallel. A maximum divergent angle between the ends of the grooves 25 in the hitting zone 23 and the hosel 30 is 12 degrees.

The top of the connector 34 intersects with and is coincident with the top ridge 20 of the club head body 12. The lower part of the connector 34 is attached to the heel portion 14 at a point substantially above the bottom sole 18, thus raising the hosel 30 and connector 34 above the ground surface during address and the execution of a golf shot. This structure also raises the center of the mass of the club head upwardly, unlike conventional golf club heads where the hosel terminates along the bottom or sole surface. The hosel 30 extends outwardly from the club head body 12 in a toe 16 to heel 14 direction. The curved planar front surface 38 of the connector 34 becomes an extension of and is coincident with the ball striking face 22, thereby totally eliminating the deep pocket normally found with conventional irons, and making the entire ball striking face 22 as provided by the additional hitting zone 23 available for striking a golf ball.

Figure 2:
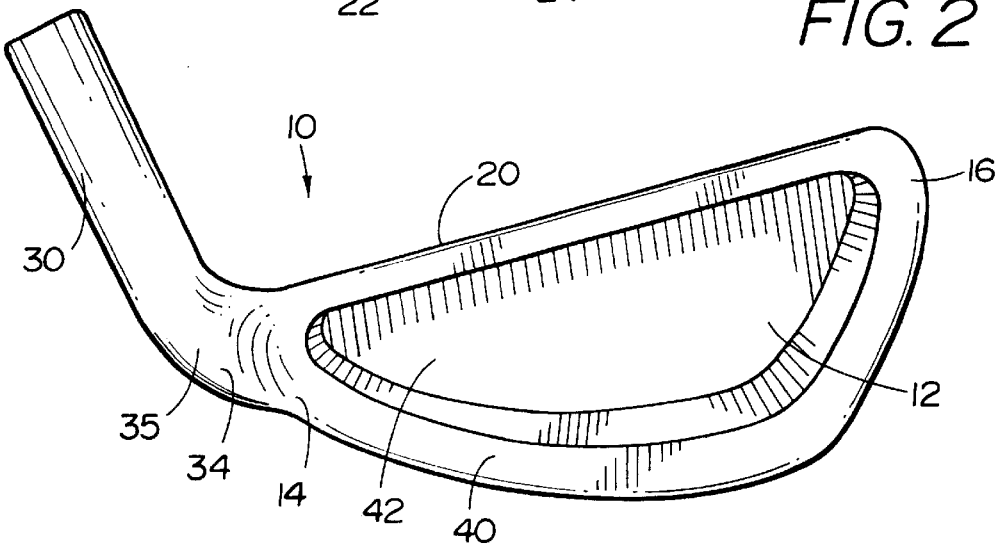
FIG. 2 is a rear elevational view of the golf club head of FIG. 1.
Figure 3:
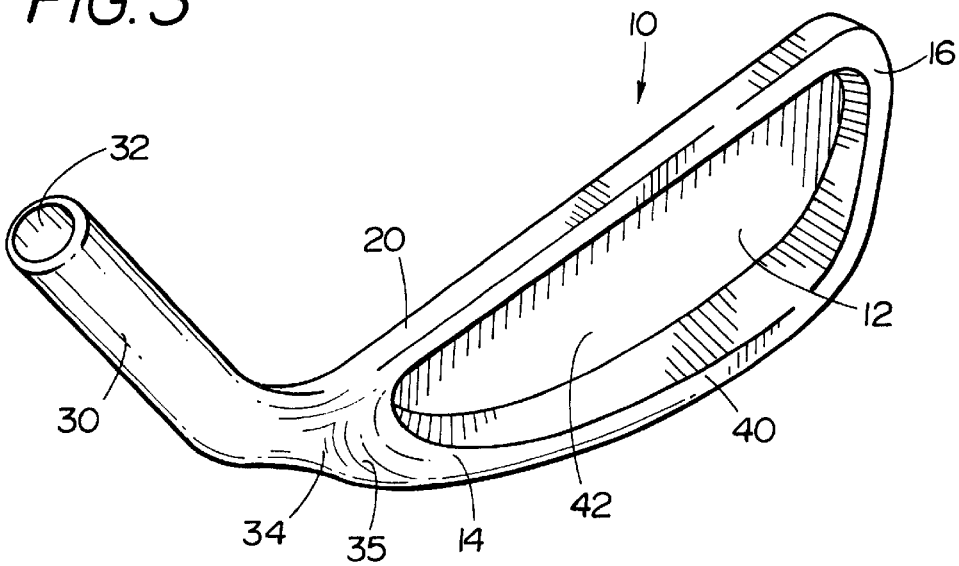
FIG. 3 is a rear perspective view of the golf club head of FIG. 1.
Figure 4:
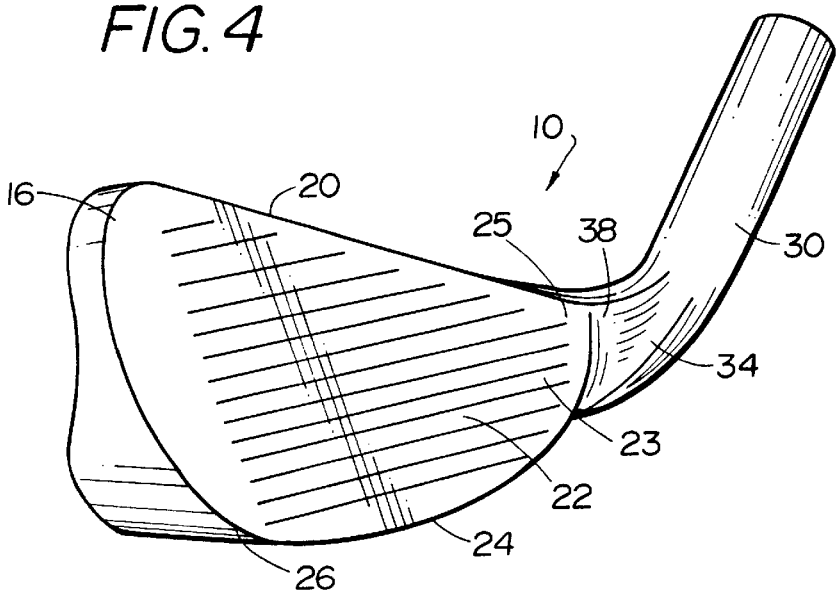
FIG. 4 is a front perspective view of the golf club head of FIG. 1.
Figure 5:
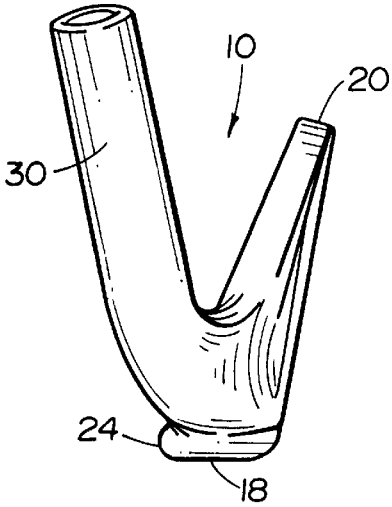
FIG. 5 is a heel end elevational view.
Figure 6:
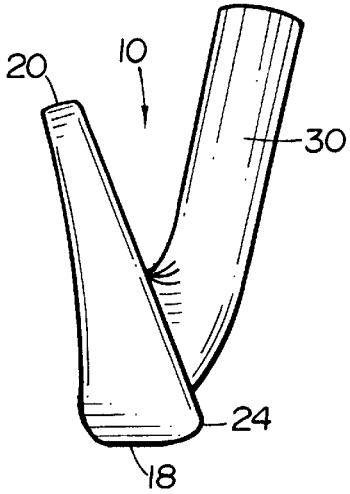
FIG. 6 is a toe end elevational view.
Figure 7:
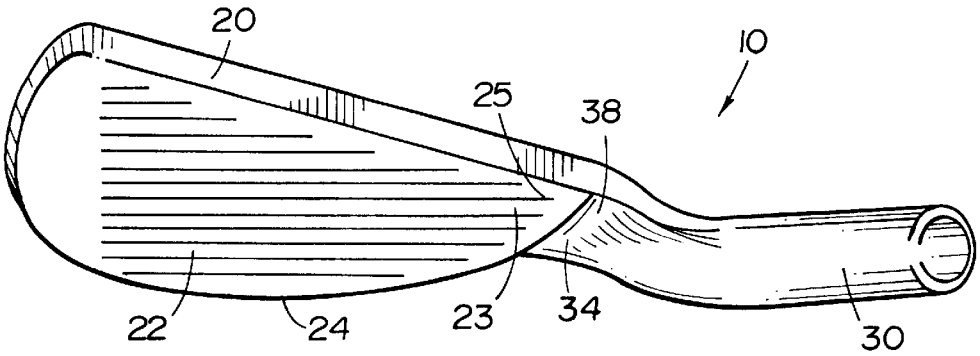
FIG. 7 is a top plan view of the golf club head of FIG. 1.

Referring to FIG. 2, the rear of the connector 34 smoothly transitions into the rear peripheral weight 40 on the back surface 42 of the club head 10 and may be a bolbus mass 35 to add strength and stability to the connector 34.

A detailed view of the hosel 30 and connector 34 is shown in the exploded view of the club head 10 in FIG. 9. The hosel 30 is cylindrical in shape and has an outside diameter of approximately ½ inch. The connector 34 gradually flattens in an increasing diameter, parabolic curved surface 38. The rear of connector 34 extends outwardly to a width of approximately ¾ inch from the hitting zone 23 adjacent the heel 14 of the club head body 12. The rear portion of the connector 34 is bulbous in shape which adds additional mass at the rear and bottom portions adjoining the hosel 30. The upper surface of the connector 34 gradually curves in a first radius to be coincident with the top ridge 20 of the club head body 12. The lower surface of the connector 34 gradually curves in a second larger curved radius to accommodate the shape of the lower heel portion 14 of the club head body 12. The connector 34 is approximately ½ inch in length which locates the hosel 30 approximately ½ inch from the club head body 12.

In a preferred embodiment, the overall length of the hosel 30 and the connector 34 is approximately 2½ inches from top to bottom, whereas the gradually curving connector 34 is approximately ⅝ inch in length in the top to bottom direction.

FIGS. 9 and 10 are exploded views showing the relationship of the enlarged hitting area 23, the connector 34 and the hosel 30 on the club head 10. The phantom hosel lines in FIG. 10 illustrate the normal location of a hosel relative to the club head body, wherein the hosel would be positioned directly above the portion of the ball striking face which form the enlarged hitting area 23 of the present invention.

Figure 12:
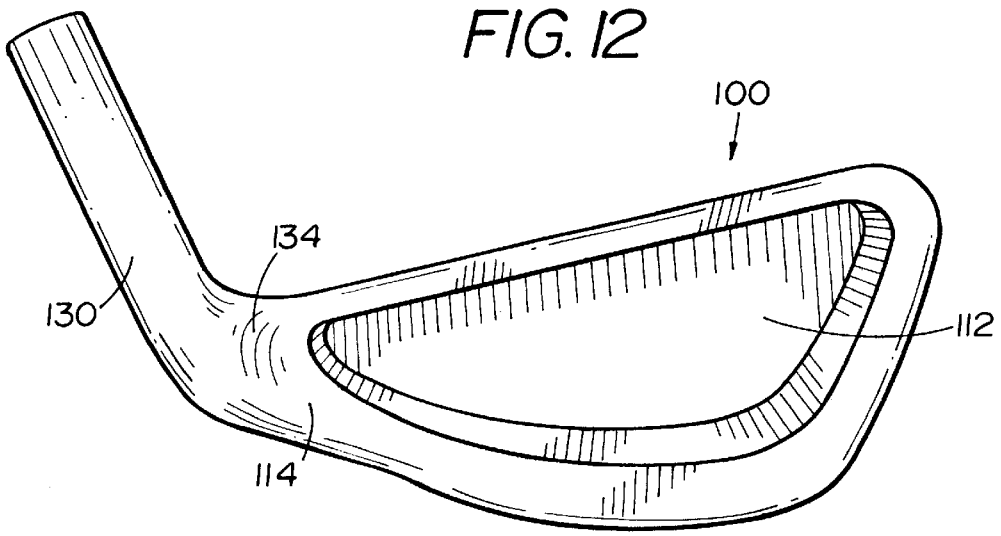
FIG. 12 is a rear elevational view of the golf club head of FIG. 11.

FIGS. 11 and 12 show a second embodiment of a golf club head 100 in accordance with the present invention. The club head 100 includes a club head body 112 and hosel 130 which is connected to the body by a connector 134 as described with respect to the first embodiment hereinabove. In this embodiment, the connector 134 is attached to the enlarged heel portion 114 of the club head 112 all the way to the sole or bottom surface 118 and gradually transitions between the bottom surface 118 and the hosel 130.

Figure 13:
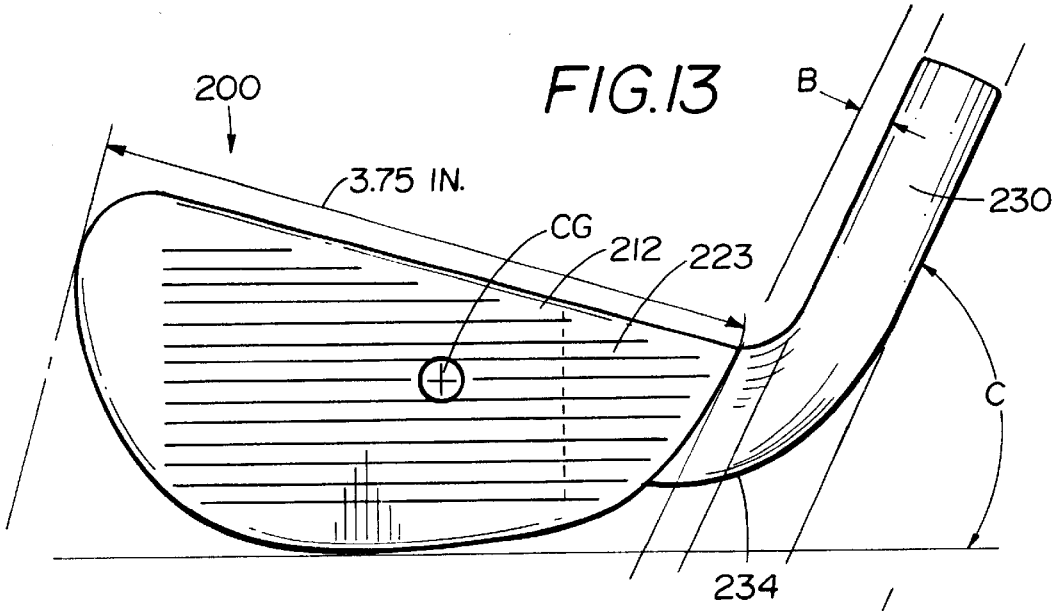
FIG. 13 is a front elevational view of a third embodiment of a golf club head in accordance with the present invention.

FIG. 13 shows a third embodiment of a golf club head 200 having a shorter angular connector 234 between the hosel 230 and the club head body 212. The width of the connector 234 defining the separation between the hosel 230 and the enlarged hitting area 223 on the club head body 212 is shown by the letter "B" and is approximately one half of the width of the hosel 230.

Figure 14:
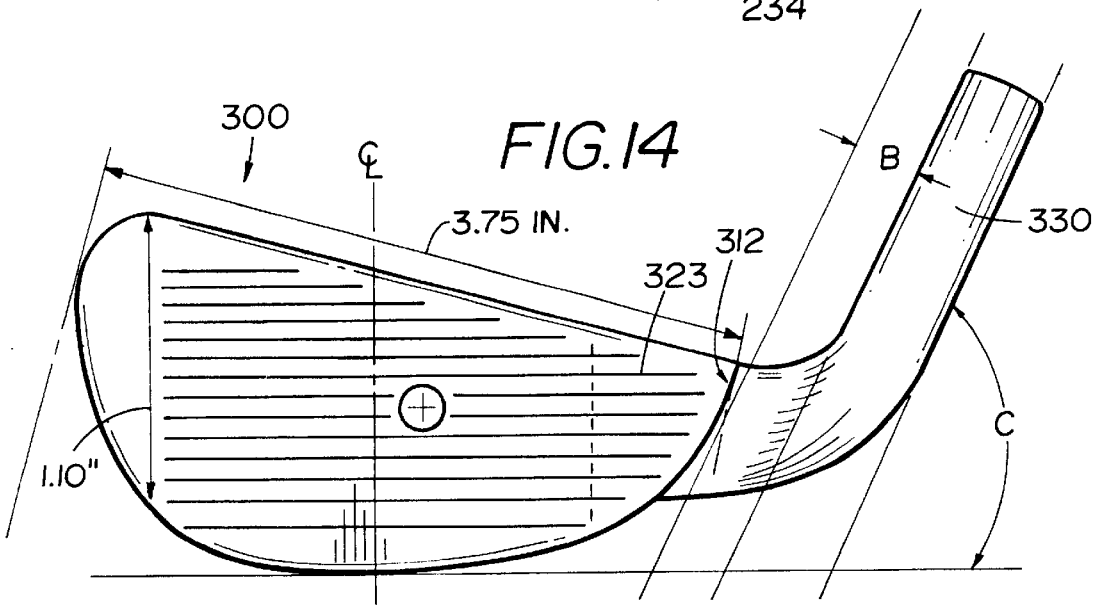
FIG. 14 is a front elevational view of a fourth embodiment of a golf club head in accordance with the present invention.

FIG. 14 shows a fourth embodiment of a golf club head 300 including a longer connector 334 between the hosel 330 and the enlarged hitting area 323 on the club head body 312. The letter "B" defines a larger separation between the edge of the hosel 330 and the edge of the enlarged hitting area 323 which is approximately the same as the width of the hosel 330.

Figure 15:
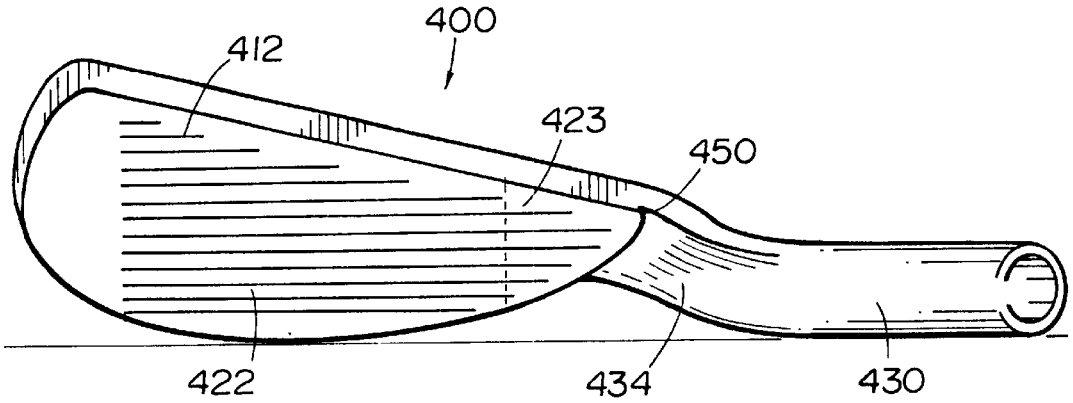
FIG. 15 is a top plan view of a fifth embodiment of a golf club head in accordance with the present invention.

FIG. 15 shows a fifth embodiment of a golf club head 400 in accordance with the present invention. In this embodiment, the connector 434 is located adjacent to an enlarged hitting area 423 and rearwardly of the ball striking face 422, which extends slightly forward of the connector 434 creating a ledge 450 between the club head body 412 and the hosel 430 and is raised therefrom, further isolating the club head striking face 422 from the hosel 430 and connector 434.

Figure 16:
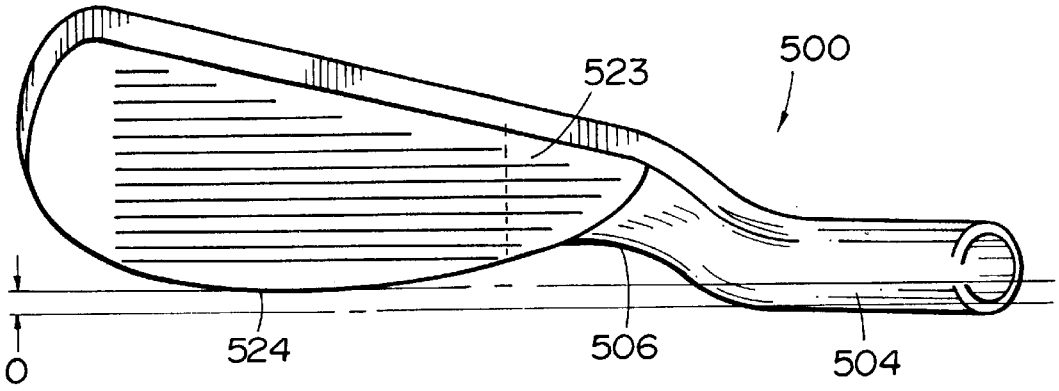
FIG. 16 is a top plan view of a club head in accordance with the present invention showing a first offset between the front edge of the hosel and the leading edge of the golf face.
Figure 17:
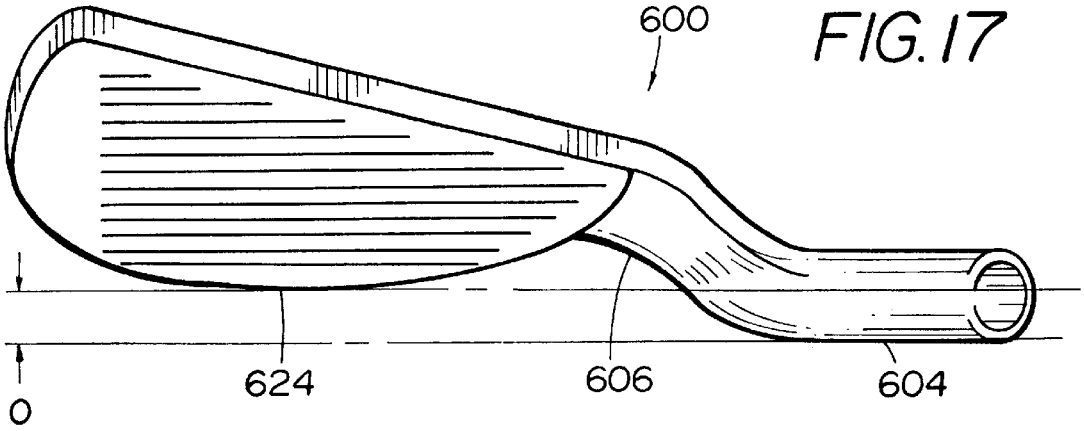
FIG. 17 is a view of a golf club head in accordance with the present invention showing a second offset between the front edge of the hosel and the leading edge of the golf club face.

FIGS. 16 and 17 both are top plan views of golf club heads 500 and 600 in accordance with the present invention. As can be seen from the drawings, the offset O between the leading edges 524 and 624 of the club head and the forward edge of the hosel 504 and 604 may be easily varied simply by varying the length and/or the angular configuration of the hosel connector 506 and 606. It will be appreciated that the degree of offset from the leading edges 524 and 624 is more easily varied than with conventional golf club heads since the offset hosel is laterally relocated from the club head body.

Figure 18:
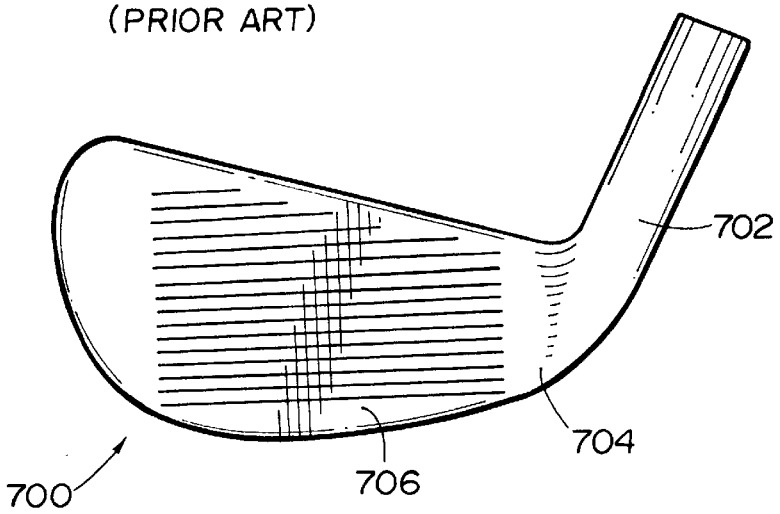
FIG. 18 (PRIOR ART)
FIG. 18 is a front elevational view of a prior art golf club head.
Figure 19:
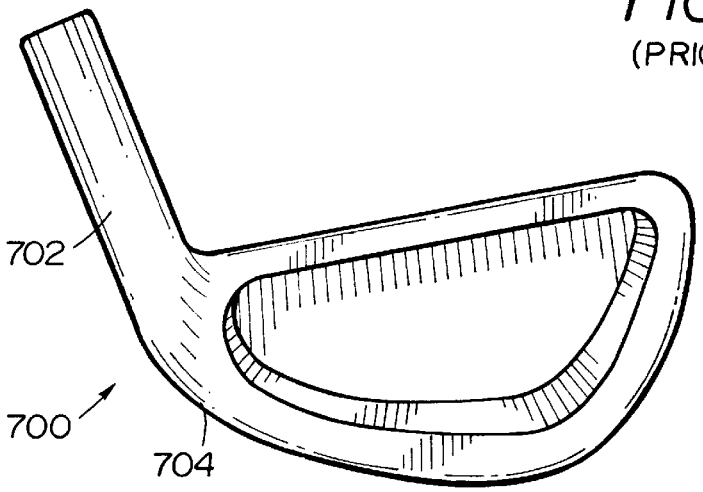
FIG. 19 (PRIOR ART)
FIG. 19 is a rear elevational view of the golf club head of FIG. 18.

FIGS. 18 and 19 is an example of a prior art conventional golf club head 700 wherein the hosel 702 is connected directly to the heel edge 704 of the ball striking face 706. These figures are provided as a reference for comparison with the hosel and connector structure of the present invention.

Although the invention is described with respect to a peripheral weighted club head, it will be appreciated that it is equally applicable to non-cavity backed designs including forged heads, muscle back heads, flat back heads, and other similar well known iron type golf club head designs.

In addition, it will be appreciated that the invention can be applied to any size of club head, including conventional standard size club heads as well as enlarged club heads.

The present invention provides an iron type golf club head and a set of such club heads when applied thereto, which are shankless in design, yet which provide a conventional look to the overall club head configuration including hosels that are offset beyond or forwardly from the leading edge of the club face.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. An iron type golf club head for hitting a golf ball including a hosel and a club head body having a heel portion, a toe portion, a bottom sole, a top ridge, and a planar, lofted ball striking face having a loft angle greater than 12 degrees and including an enlarged hitting area adjacent said heel portion; a leading edge formed at an interface of said bottom sole and said ball striking face; an outer periphery of the club head body formed by outward exterior surfaces of said heel portion, said top ridge, said toe portion and said bottom sole;

a connector attached to said club head body at said enlarged hitting area adjacent said heel portion; said connector being further defined as including an upper edge coincident with said top ridge of said club head body;

said connector located between said hosel and said club head body, separating the hosel from said enlarged hitting area on said ball striking face;

said hosel permanently and non-rotatably fixed to said connector, the entire hosel being laterally located beyond said outer periphery of said club head;

said hosel extending forwardly of said leading edge of said ball striking face in a rear to front direction;

said hosel including an upward portion for connection to a golf shaft.

2. The golf club head of claim 1 wherein said connector is curved inwardly toward said ball striking face.

3. The golf club head of claim 1 wherein said lower edge of said connector is attached to said club head body at said heel portion coincident with said bottom sole.

4. The golf club head of claim 1 wherein the width of said connector is approximately the same as the width of said hosel.

5. The golf club head of claim 1 wherein the width of said connector is approximately half the width of said hosel.

6. The golf club head of claim 1 wherein said connector is located rearwardly of said ball striking face.

7. The golf club of claim 1 wherein said enlarged hitting area is further defined as an area on said heel portion adjacent said connector.

8. An iron type golf club head for hitting a golf ball including a hosel and a club head body having a heel portion, a toe portion, a bottom sole, a top ridge, and a planar, lofted ball striking face having a loft angle greater than 12 degrees and including an enlarged hitting area adjacent said heel portion; a leading edge formed at an interface of said bottom sole and said ball striking face; an outer periphery of the club head body formed by outward exterior surfaces of said heel portion, said top ridge, said toe portion and said bottom sole;

a connector attached to said club head body at said enlarged hitting area adjacent said heel portion; said connector being further defined by a planar front surface between said hosel and said club head body;

said connector located between said hosel and said club head body, separating the hosel from said enlarged hitting area on said ball striking face;

said hosel permanently and non-rotatably fixed to said connector, the entire hosel being laterally located beyond said outer periphery of said club head;

said hosel extending forwardly of said leading edge of said ball striking face in a rear to front direction;

said hosel including an upward portion for connection to a golf shaft.

9. The golf club head of claim 8, wherein said connector becomes increasingly wider toward said club head body.

10. The golf club head of claim 9, wherein said planar front surface is coincident with said ball striking face.

11. An iron type golf club head for hitting a golf ball including a hosel and a club head body having a heel portion, a toe portion, a bottom sole, a top ridge, and a planar, lofted ball striking face having a loft angle greater than 12 degrees and including an enlarged hitting area adjacent said heel portion; a leading edge formed at an interface of said bottom sole and said ball striking face; an outer periphery of the club head body formed by outward exterior surfaces of said heel portion, said top ridge, said toe portion and said bottom sole;

a connector attached to said club head body at said enlarged hitting area adjacent said heel portion; said connector being further defined by a lower edge attached to said club head body at said heel portion above said bottom sole;

said connector located between said hosel and said club head body, separating the hosel from said enlarged hitting area on said ball striking face;

said hosel permanently and non-rotatably fixed to said connector, the entire hosel being laterally located beyond said outer periphery of said club head;

said hosel extending forwardly of said leading edge of said ball striking face in a rear to front direction;

said hosel including an upward portion for connection to a golf shaft.

* * * * *